US005753166A

United States Patent [19]

Dalton et al.

[11] Patent Number: 5,753,166

[45] Date of Patent: May 19, 1998

[54] PROCESS OF MAKING A NON-CIRCULAR CROSS-SECTIONAL FIBER

[75] Inventors: J. Nelson Dalton, Kingsport; Bobby M. Phillips, Jonesborough, both of Tenn.

[73] Assignee: Eastman Chemical Company, Kingsport, Tenn.

[21] Appl. No.: 734,538

[22] Filed: Oct. 21, 1996

Related U.S. Application Data

[62] Division of Ser. No. 639,229, Apr. 29, 1996, abandoned.

[51] Int. Cl.[6] ..... D01D 5/253

[52] U.S. Cl. ..... 264/177.13; 264/211

[58] Field of Search ..... 264/177.13, 211

[56] References Cited

U.S. PATENT DOCUMENTS

| | | | |
|---|---|---|---|
| 3,193,516 | 7/1965 | Broatch et al. | 264/170 |
| 3,914,488 | 10/1975 | Gorrafa | 264/177.13 X |
| 4,380,594 | 4/1983 | Siggel et al. | 521/182 |
| 4,766,181 | 8/1988 | Ostrozynski et al. | 428/395 |
| 4,923,914 | 5/1990 | Nohr et al. | 524/99 |
| 5,057,368 | 10/1991 | Largman et al. | 264/177.13 X |

FOREIGN PATENT DOCUMENTS

| | | |
|---|---|---|
| 0 114 348 | 8/1984 | European Pat. Off. . |
| 93 70313 | 4/1993 | WIPO . |

OTHER PUBLICATIONS

Derwent Abstracts WPI Accession No. 87–097854, Japan 62–45,722 (Published Feb. 27, 1987).

*Primary Examiner*—Leo B. Tentoni
*Attorney, Agent, or Firm*—Cheryl J. Tubach; Harry J. Gwinnell

[57] ABSTRACT

A melt extrusion composition made by combining about 99.9 to about 98.5 weight percent of at least one polyester and about 0.1 to about 1.5 weight percent additive provides for a polyester or copolyester non-circular cross-sectional fiber having at least four percent improved shape retention as compared to the same fiber made from a melt extrusion composition without the additive. The additive is present at the air-polymer interfacial surface during melt spinning. A method of making the fiber is also disclosed.

9 Claims, 10 Drawing Sheets

PROCESS OF MAKING A NON-CIRCULAR CROSS-SECTIONAL FIBER

This a divisional application of application Ser. No. 08/639,229, filed Apr. 29, 1996, now abandoned.

TECHNICAL FIELD

This invention relates generally to non-round cross-sectional shaped synthetic fibers. More particularly, this invention relates to additives for polymeric fluids which preserve the cross-sectional shape of the fibers through reduction in surface tension forces of the polymeric fluids.

BACKGROUND OF THE INVENTION

Certain benefits are derived from synthetic fibers having cross-sectional shapes other than round. Fluid movement, high bulk, insulation value, tactile, and visual aesthetics are some of the many benefits. These non-round cross-sectional shaped fibers are obtained from melt spinning and solvent spinning of polymeric fluids. Spinneret hole shapes are designed to provide the desired cross-sectional shape of these fibers.

During the spinning of these non-circular cross-sectional shaped fibers, surface tension forces in the spinning fluids act to deform, i.e. make circular, the cross-sectional shapes engineered into the fibers through the spinneret hole designs. However, the melt viscosity of the polymeric fluid counteracts the surface tension forces. Thus, the degree to which the original cross-sectional shapes are deformed depends on the initial value of the melt viscosity-to-surface tension ratio, as well as the intensity of solidification.

Prior art aimed at improving the retention of noncircular cross-sectional shapes in fibers includes reinforcement of the melt viscosity or reduction of the surface tension forces. Reinforcement of the melt viscosity has been accomplished by reduction of melt spinning temperature, by accelerated quenching, by increasing the molecular weight, or by modification of the chemical structure.

Reduction of the surface tension forces in polymeric fluids has been obtained for trilobal filament cross sections of nylon by the addition of surface active additives to the melt spinning process. In particular, a primary aliphatic amide of a fatty acid and an ethoxylated fatty acid markedly improved cross-sectional shape retention of nylon fibers as demonstrated in the comparative examples below.

U.S. Pat. No. 4,923,914 to Nohr et al. discloses the use of an additive having moieties A and B for providing desired characteristics in a thermoplastic composition. The moieties together are compatible with the thermoplastic composition at its melt extrusion temperature and incompatible as separate compounds. It is moiety B that provides for the desired characteristic. Those characteristics disclosed in the Nohr patent are improved wettability, enhanced hydrophobicity, buffering capacity, ultraviolet light absorption, and light stabilization. The desired characteristic of improved shape retention was not disclosed.

Thus, the prior art teaches that surface tension forces act to reduce non-circular cross-sectional shapes to circular and that specific categories of surface active agents have been shown to be effective in preserving the cross-sectional shape of nylon fibers. However, no prior art discloses which additives, if any, are effective in preserving the cross sectional shape of polyester fibers. Accordingly, it is to the provision of such improved shape retention in polyester fibers having non-circular cross-sections that the present invention is primarily directed.

SUMMARY OF THE INVENTION

The present invention provides a melt extrusion composition made by combining about 99.9 to about 98.5 weight percent of at least one polyester and about 0.1 to about 1.5 weight percent additive. A polyester or copolyester non-circular cross-sectional fiber made from the melt extrusion composition has at least four percent improved shape retention as compared to a second fiber having the same non-circular cross-section made from a second melt extrusion composition of the at least one polyester without the additive. The additive concentrates at the air-polymer interfacial surface during melt spinning.

The present invention also provides for a method of improving shape retention of a non-circular cross-sectional fiber. The first step of the method requires combining about 99.9 to about 98.5 weight percent of at least one polyester and about 0.1 to about 1.5 weight percent additive to form a melt extrusion composition. The melt extrusion composition is then extruded through a non-circular cross-sectional shaped spinneret hole to form a fiber having at least four percent improved shape retention as compared to a second fiber made from a second melt extrusion composition of the at least one polyester without the additive and extruded through the spinneret hole. The fiber is quenched and then taken up.

DETAILED DESCRIPTION OF THE INVENTION

Figure 1:
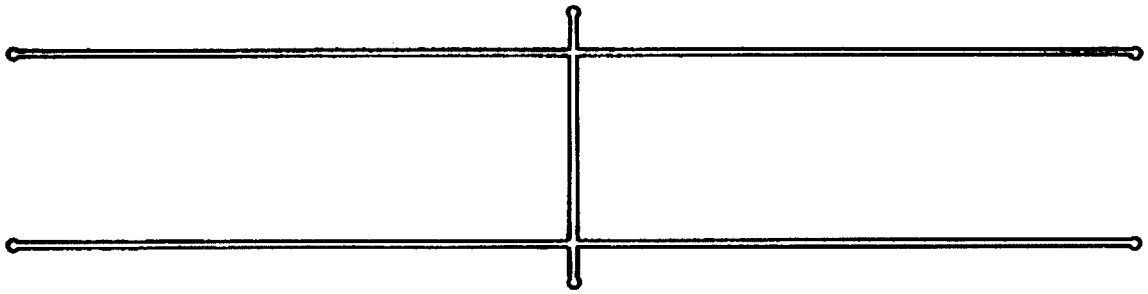
FIG. 1 is a spinneret hole for a fiber having a H-shaped cross section for use in the Examples of the present invention.

This invention provides for reduction of surface tension forces in a spinning fluid of a molten polyester or copolyester resin during the melt spinning process by the use of a surface active additive. Preferably, the additive is a silicone, silicone copolymer or fluoro-aliphatic polymeric ester and is present in a melt extrusion composition. The melt extrusion compositions are made by combining about 99.9 to about 98.5 weight percent of at least one polyester and about 0.1 to about 1.5 weight percent additive, and preferably about 99.6 to about 99.0 weight percent of at least one polyester and about 0.4 to about 1.0 weight percent additive. The resulting polyester fibers spun from the melt extrusion compositions have at least four percent, and preferably forty percent, improved cross-sectional shape retention as compared to fibers having the same shape and made from melt extrusion compositions not containing the additives.

The surface tension of neat molten polyesters and copolyesters at 270°–300° C. is approximately 28–26 dynes/cm. During melt spinning the molten filament is subject to surface tension forces which are capable of deforming the filament shape. Thus, in order to effectively maintain the shape of the fiber in its molten filament state the surface tension of the molten polyesters must be lowered without adversely affecting the surface tension to viscosity ratio of the polymer. By using the additives of the present invention such desired results are achievable. The additive influences the surface of the filament at the mono-molecular air-polymer interface during melt spinning in order to achieve the desired shape retention.

To measure improved shape retention, the shape factor of a filament prepared with the additive is compared to the shape factor of the same filament prepared with no additive. The shape factor is defined as:

$$\text{SHAPE FACTOR} = \text{PERIMETER}/\sqrt{4 \cdot 3.14 \cdot \text{AREA}}$$

wherein the perimeter and the area are of the fiber cross-section. A higher shape factor for a filament from a specific spinneret indicates better shape retention. Percent improvement in shape retention is defined as:

$$\%\ \text{IMPROVEMENT} = \frac{\text{SHAPE FACTOR WITH ADDITIVE} \cdot 100}{\text{SHAPE FACTOR WITH NO ADDITIVE}} - 100$$

The fiber s of the present invention are made by combining about 99.9 to about 98.5 weight percent of at least one polyester and about 0.1 to about 1.5 weight percent additive to form a melt extrusion composition. The melt extrusion composition is extruded through a non-circular cross-sectional shaped spinneret hole to form a fiber. The fiber is quenched, and then taken up. The fiber, when compared to a second fiber made the same way except that the melt extrusion composition does not contain the additive, has improved shape retention of at least four percent, preferably forty percent.

EXAMPLES 1–8

The additives in Examples 1–8 are polydimethylsiloxane (PDMS) fluids of varying weight average molecular weights, as listed below.

TABLE 1

Molecular Weight and Viscosity of PDMS Additives

| PDMS EXAMPLE | MOLECULAR WEIGHT | VISCOSITY (Cstk.) |
|---|---|---|
| 1 | 3800 | 50 |
| 2 | 6000 | 100 |
| 3 | 9400 | 200 |
| 4 | 13700 | 350 |
| 5 | 17300 | 500 |
| 6 | 28000 | 1000 |
| 7 | 49300 | 5000 |
| 8 | 62700 | 10000 |

Using a metering pump, the PDMS fluids are added in amounts from 0.1 to 2.0 weight percent (wt %) to the feed throat of a one inch extruder having a length/diameter ratio of 24/1. The extruder operated at a melt output temperature of 285° C. while extruding polyethylene terephthalate (PET) having an inherent viscosity of 0.61 as measured in 65%/735% phenol/tetrachloroethane. The feed polyester was dried at 115° C. for 8 hours in a Patterson vacuum tumble dryer. The fibers were spun from non-circular cross-sectional spinneret holes having a H shaped cross-section as shown in FIG. 1. The fibers were quenched with ambient cross flow air at a velocity of 31 feet per minute. The fibers were taken up by winding at 1000 meters per minute. The as-spun fibers were 30 denier per filament each.

The shape factor of the individual as-spun filaments was measured with a computer based image analysis technic. The image analysis system consisted of a microscope, a video camera, a personal computer based image processing workstation, a video monitor and a video printer.

Figure 2:
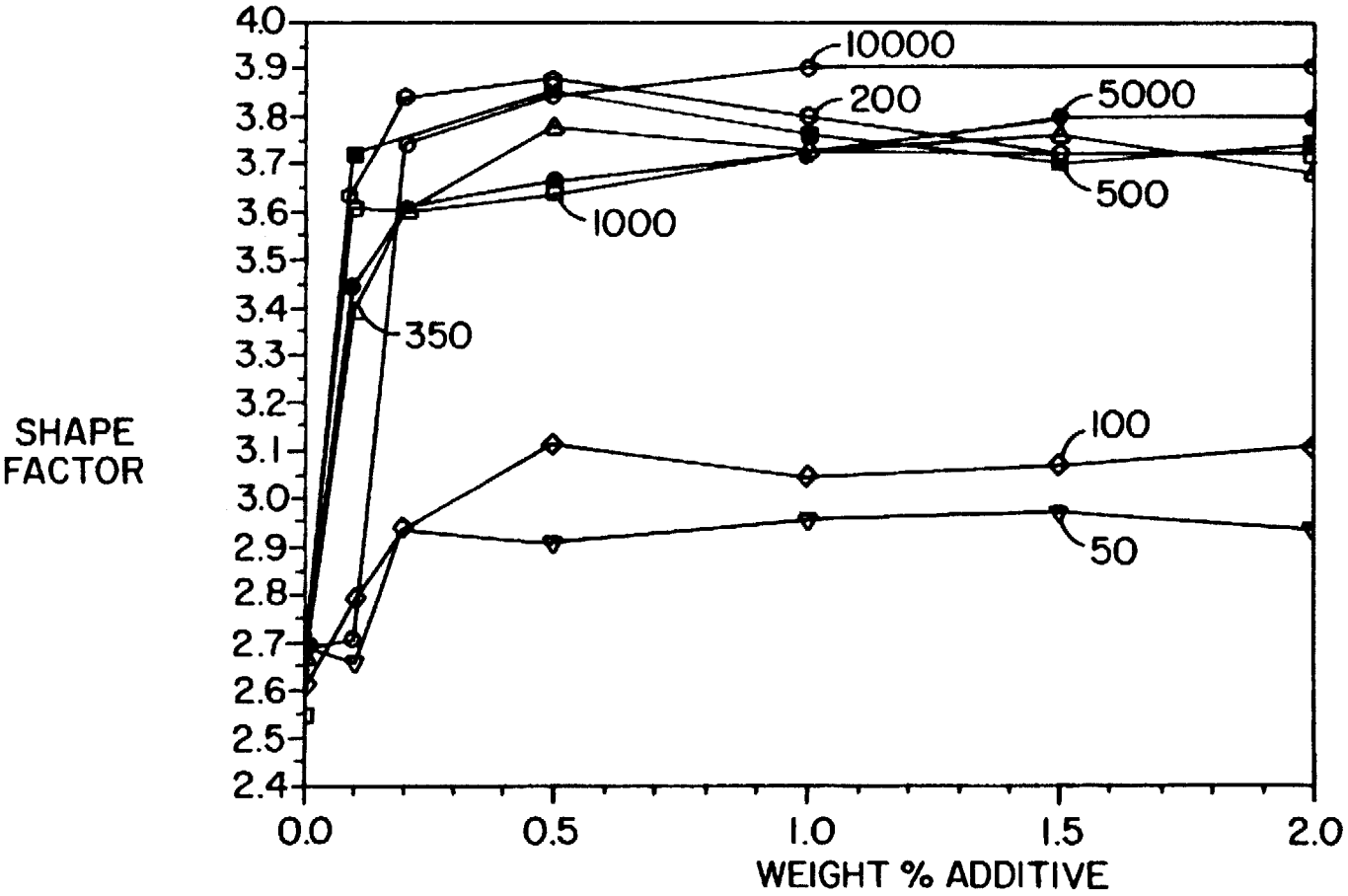
FIG. 2 is a graph showing the effect of the amount of PDMS additives on the shape factor of the polyester fibers of Examples 1–8.

The effect of the amount of additive on the shape factor is shown for Examples 1–8 in FIG. 2. A comparison is made of a control with no additive to the Examples having varying amounts of PDMS fluids. Significant improvement in the shape factor was seen with all Examples. The PDMS fluids having a viscosity of 200 centistokes (molecular weight =9400) or greater showed higher improvement in shape factor. No major increase in the shape retention was seen by increasing the level of PDMS fluids above about 0.5 wt %. A 40 percent improvement in shape factor was observed with the addition of PDMS fluids in these Examples.

Figure 3:
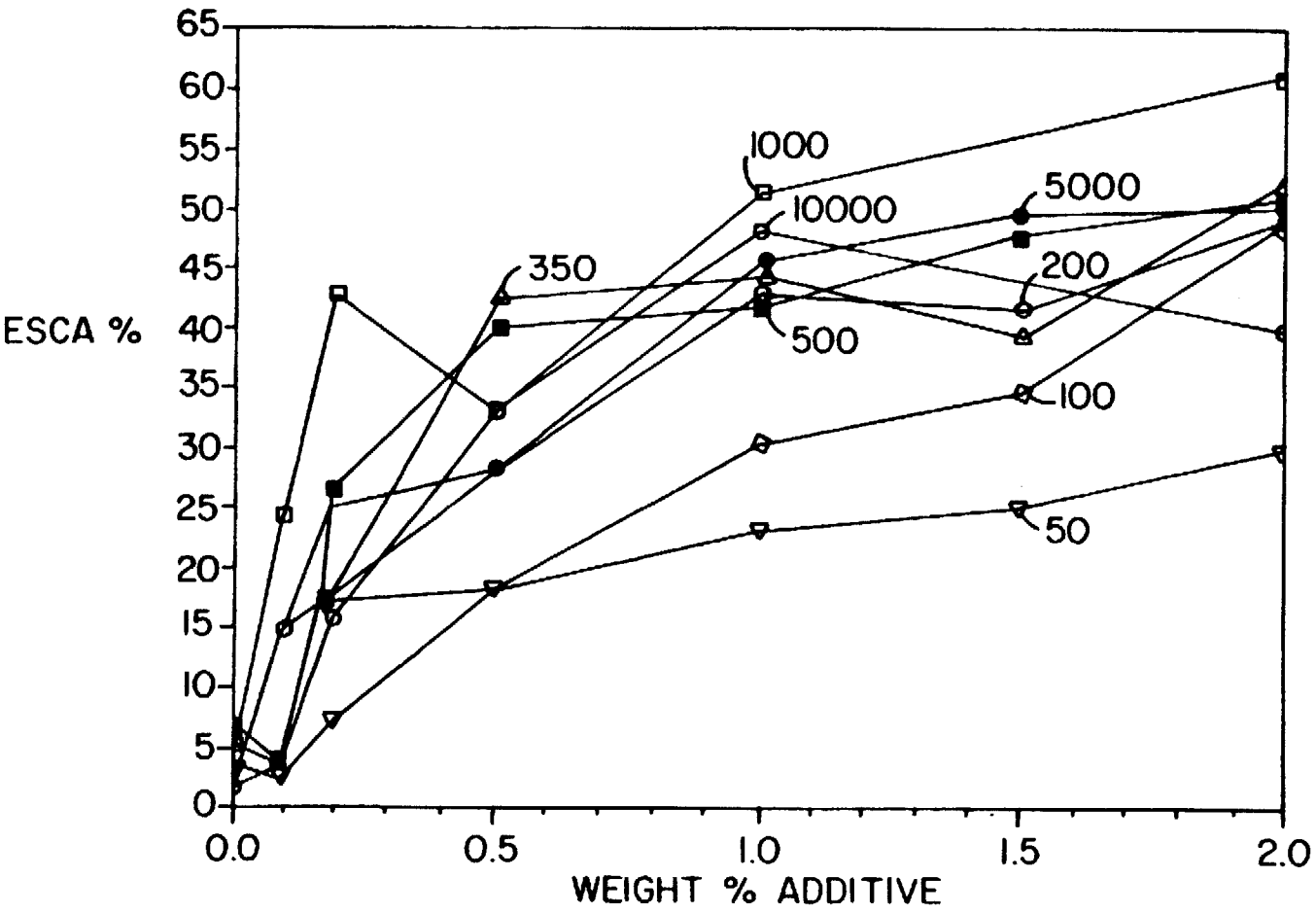
FIG. 3 is graph showing the effect of the amount of PDMS additives on the ESCA percentage for Examples 1–8.

The level of PDMS additive on the surface of the fiber was measured by electron spectroscopy for chemical analysis (ESCA). The PDMS level on the surface as a function of bulk level in the fiber is shown in FIG. 3. The surface level was obtained from measurements of the amount of elemental silicon on the surface and converted to the level of additive knowing the percentage of silicon in the additive.

Figure 4:
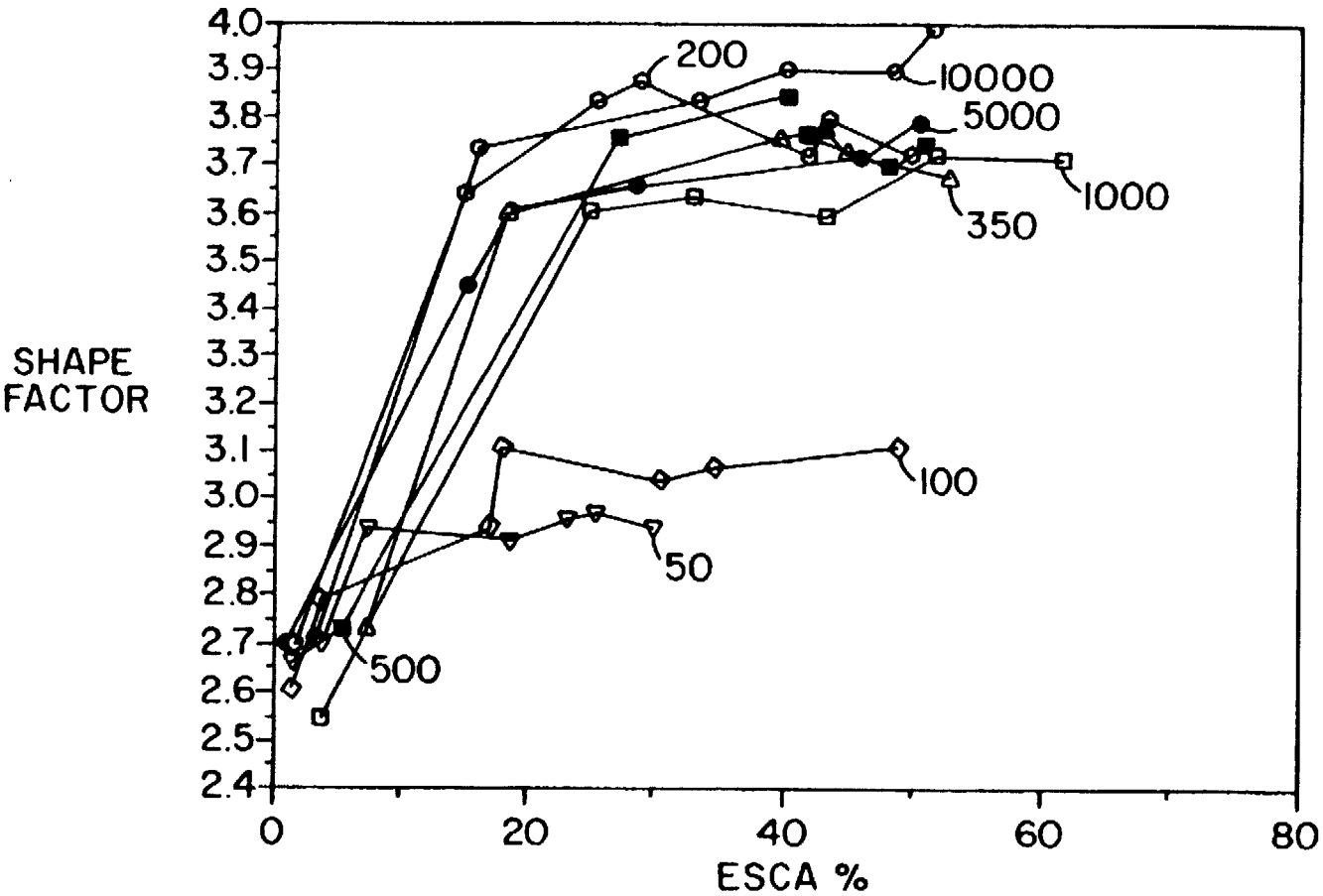
FIG. 4 is graph showing the effect of the ESCA % on the shape factor of the polyester fibers with PDMS additive in Examples 1–8.

The effect of the ESCA measured level of PDMS additive on the surface of the filament on shape factor is shown in FIG. 4. For the PDMS fluids having a viscosity of 200 ctsk. or greater, about 15% additive on the surface of the room temperature filament produced shape factors of about 3.5 and above, whereas the control with no additive had an average shape factor of 2.7. Filament surface levels of up to about 60% were measured with shape factors as high as 4.0.

EXAMPLES 9–15

Figure 5:
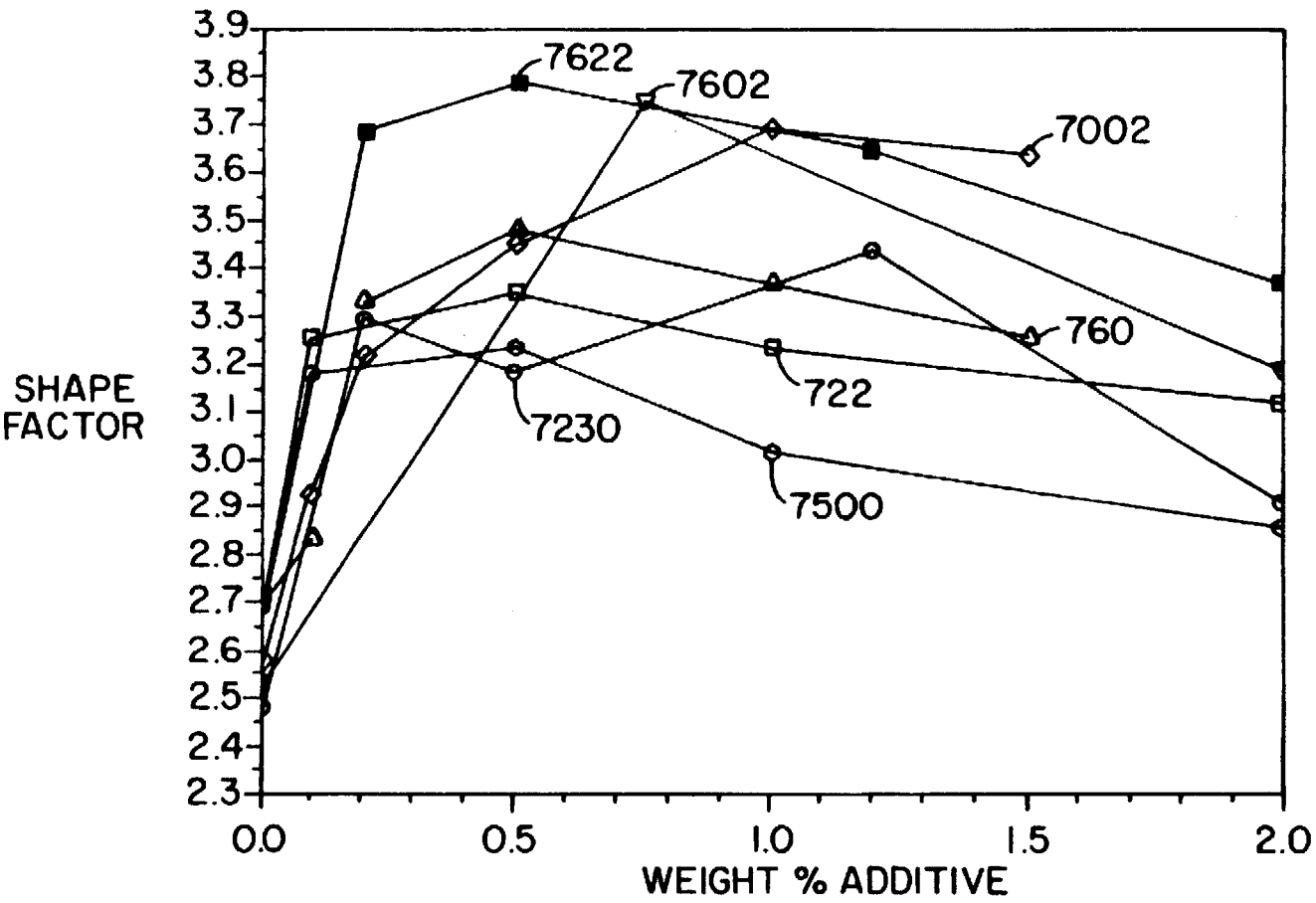
FIG. 5 is a graph showing the effect of the amount of SILWET® additives on the shape factor of the polyester fibers of Examples 9–15.
Figure 6:
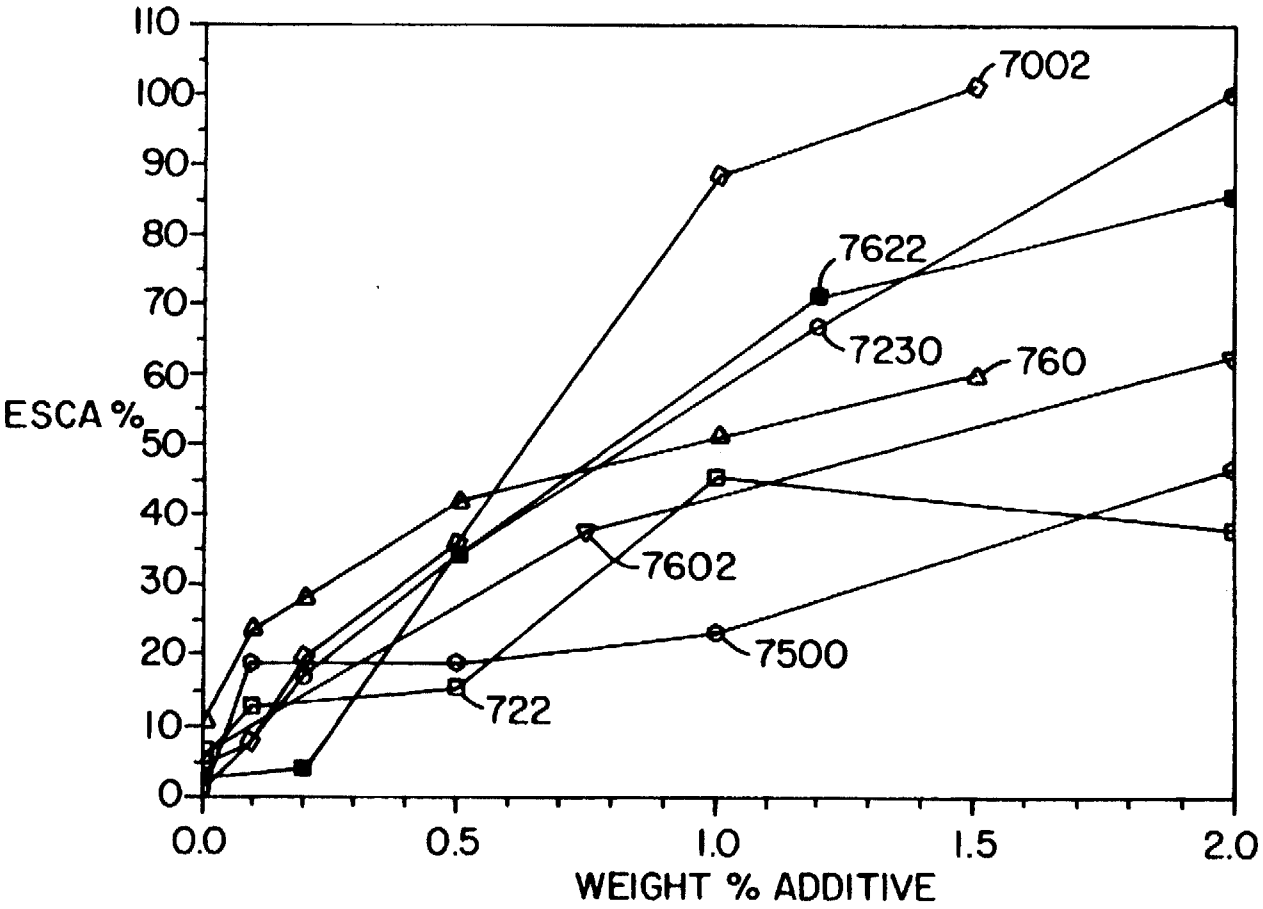
FIG. 6 is graph showing the effect of the amount of SILWET® additives on the ESCA percentage for Examples 9–15.

Silicone copolymers which provide improved shape retention are SILWET® 7002, 7600, 722, 7602, 7230, 7500, and 7622, available from OSi Specialties, Inc. of Danbury, Conn. These copolymers are polyalkene oxide modified polydimethyl siloxanes. Example 9–15 were obtained using these silicone copolymers and the same melt spinning conditions as in Examples 1–8. The resultant data of the effect of the amount of additive on shape factor is shown in FIG. 5. The level of additive on the surface of the filament (measured by ESCA) as a function of the bulk level of the additive metered into the polyester polymer is shown in FIG. 6.

The silicone copolymers have a wide range of hydrophile to lipophile ratio (HLB) depending on the design of the molecule as noted in Table 2. Those which have a low HLB range (5–8), a mid HLB range (9–12), or a high HLB range (13–17) all provide shape retention regardless of their HLB value.

TABLE 2

Silwet Silicone Copolymers Showing Shape Retention

| EXAMPLE | ADDITIVE | MOLECULAR WT | EST. HLB |
|---|---|---|---|
| 9 | SILWET L-7002 | 8000 | 9–12 |
| 10 | SILWET L-7600 | 4000 | 13–17 |
| 11 | SILWET L-722 | 3000 | 5–8 |
| 12 | SILWET L-7602 | 3000 | 5–8 |
| 13 | SILWET L-7230 | 30000 | 9–12 |
| 14 | SILWET L-7500 | 3000 | 5–8 |
| 15 | SILWET L-7622 | 10000 | 5–8 |
| 16 | TEGOPREN 5863 | 15444 | |
| 17 | TEGOPREN 5830 | | |
| 18 | MASIL 1066C | 6359 | |
| 19 | MASIL 1066D | 7677 | |

EXAMPLES 16–17

Figure 7:
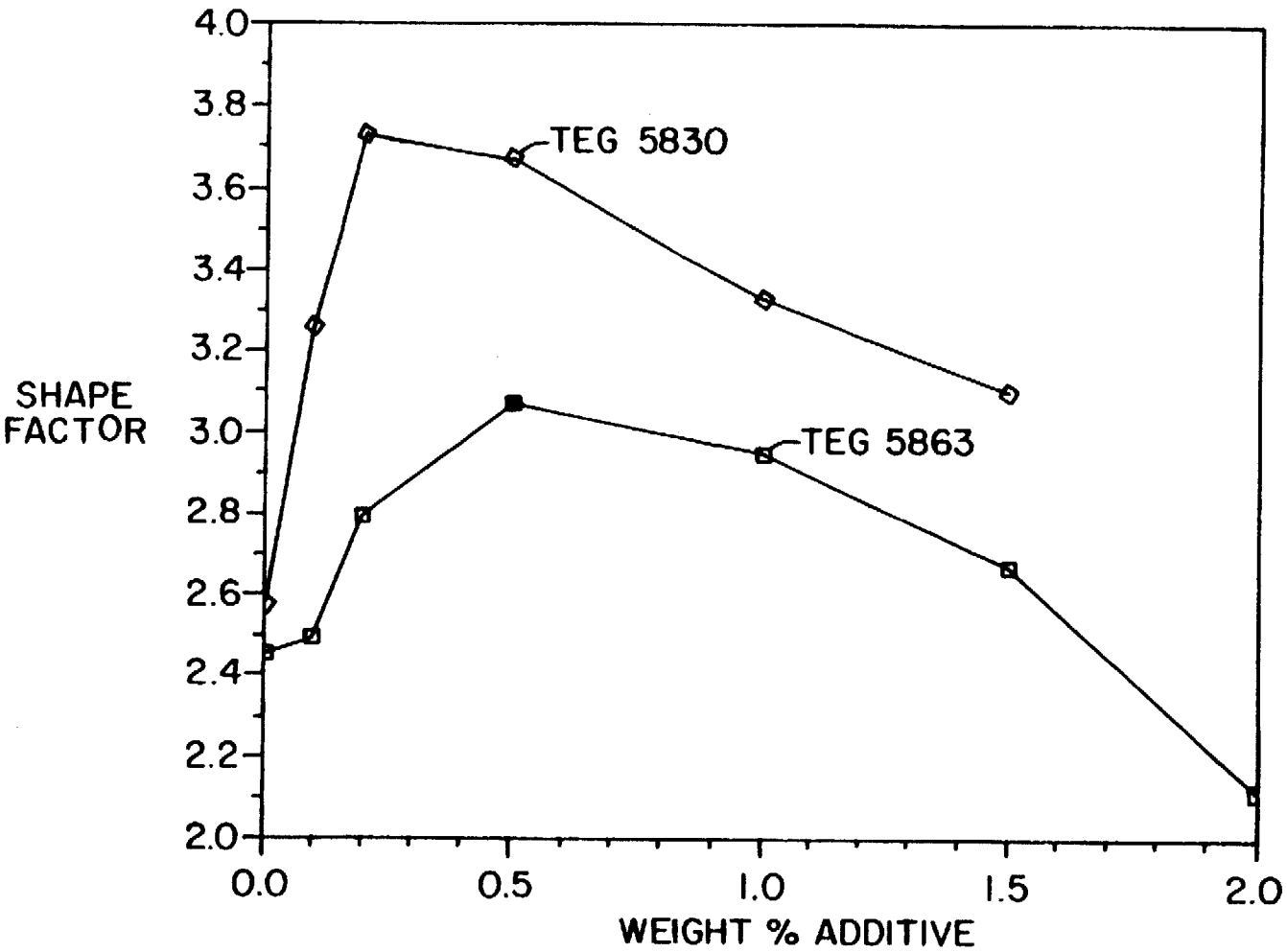
FIG. 7 is a graph showing the effect of the amount of TEGOPREN® additives on the shape factor of the polyester fibers of Examples 16–17.

Examples 16 and 17 (Table 2) are TEGOPREN® silicone copolymers which provide shape retention. These copolymers are polyether-polydimethylsiloxanes available from Goldschmidt Chemical Corporation of Hopewell, Va. Their application to the polyester filament is as described in Examples 1–8. FIG. 7 shows the comparison of shape retention to wt % of additive.

EXAMPLES 18–19

Figure 8:
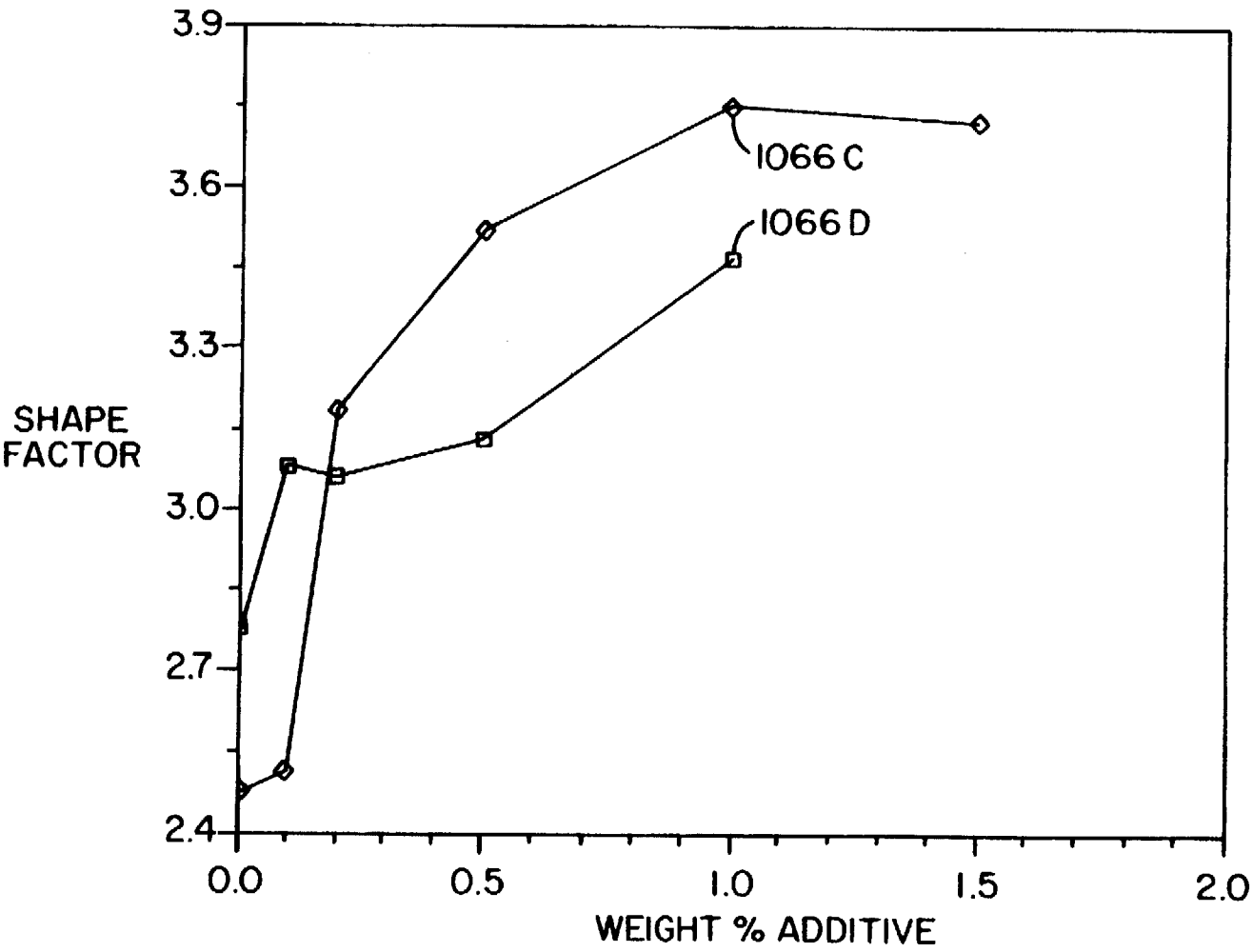
FIG. 8 is graph showing the effect of the amount of MASIL® additives on the shape factor of the polyester fibers of Examples 18–19.

Examples 18 and 19 (Table 2) are MASIL® silicone copolymers which, when applied according to Examples 1–8, show improved shape retention for polyester filaments. These copolymers are polyalkylene oxide modified silicones. The shape data is shown in FIG. 8. These copolymers are available from Mazer Chemicals, a division of PPG Industries, Inc., of Gurnee, Ill.

EXAMPLE 20

Figure 9:
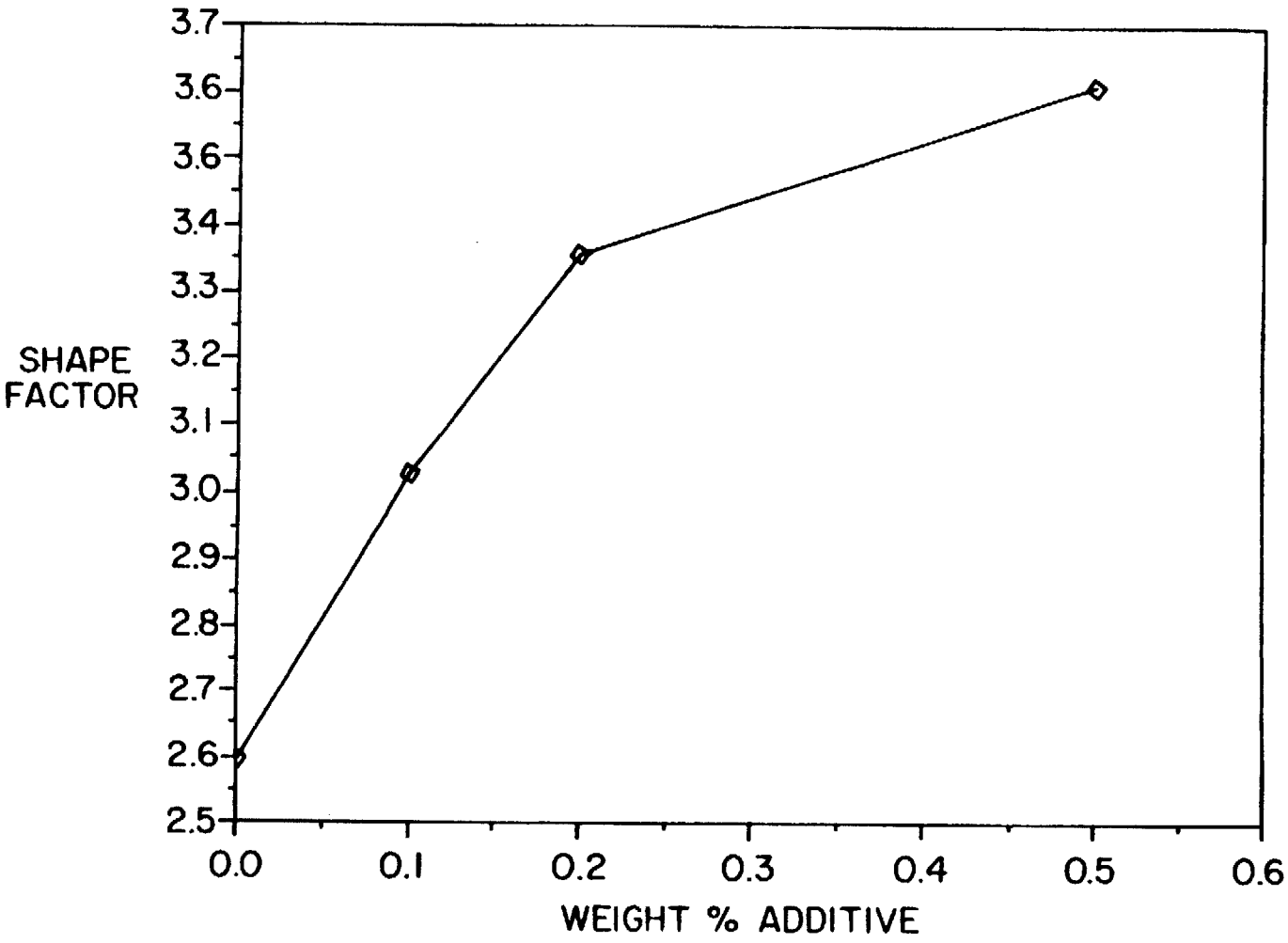
FIG. 9 is graph showing the effect of the amount of fluoroaliphatic polymeric ester additive on the shape factor of the polyester fibers of Example 20.

Example 20 is a fluoroaliphatic polymeric ester additive which provides effective shape retention in polyester polymers. Its application to the molten filament is the same as in Examples 1–8. The effect of additive level on the shape factor is seen in FIG. 9.

EXAMPLE 21–25 (COMPARATIVE)

Examples 21 and 22 demonstrate the repeatability of the shape retention prior art disclosed for nylon as disclosed in an article published in Chemiefasern/Textileindustrie, 24/76, 1974 by Gerhard Nachtrab and Heinz Gilch entitiled: "Improvement of Noncircular Filament Cross Sections Through Surface-Active Additives During Melt Spinning". Examples 23–25 demonstrate that such additives are ineffective with the polyesters of the present invention.

TABLE 3

| EXAMPLE | TRADE NAME | POLYMER |
|---|---|---|
| 21 | TWEEN 80 | NYLON |
| 22 | TWEEN 81 | NYLON |
| 23 | TWEEN 80 | POLYESTER |
| 24 | TWEEN 81 | POLYESTER |
| 25 | KENAMIDE S | POLYESTER |

Figure 10:
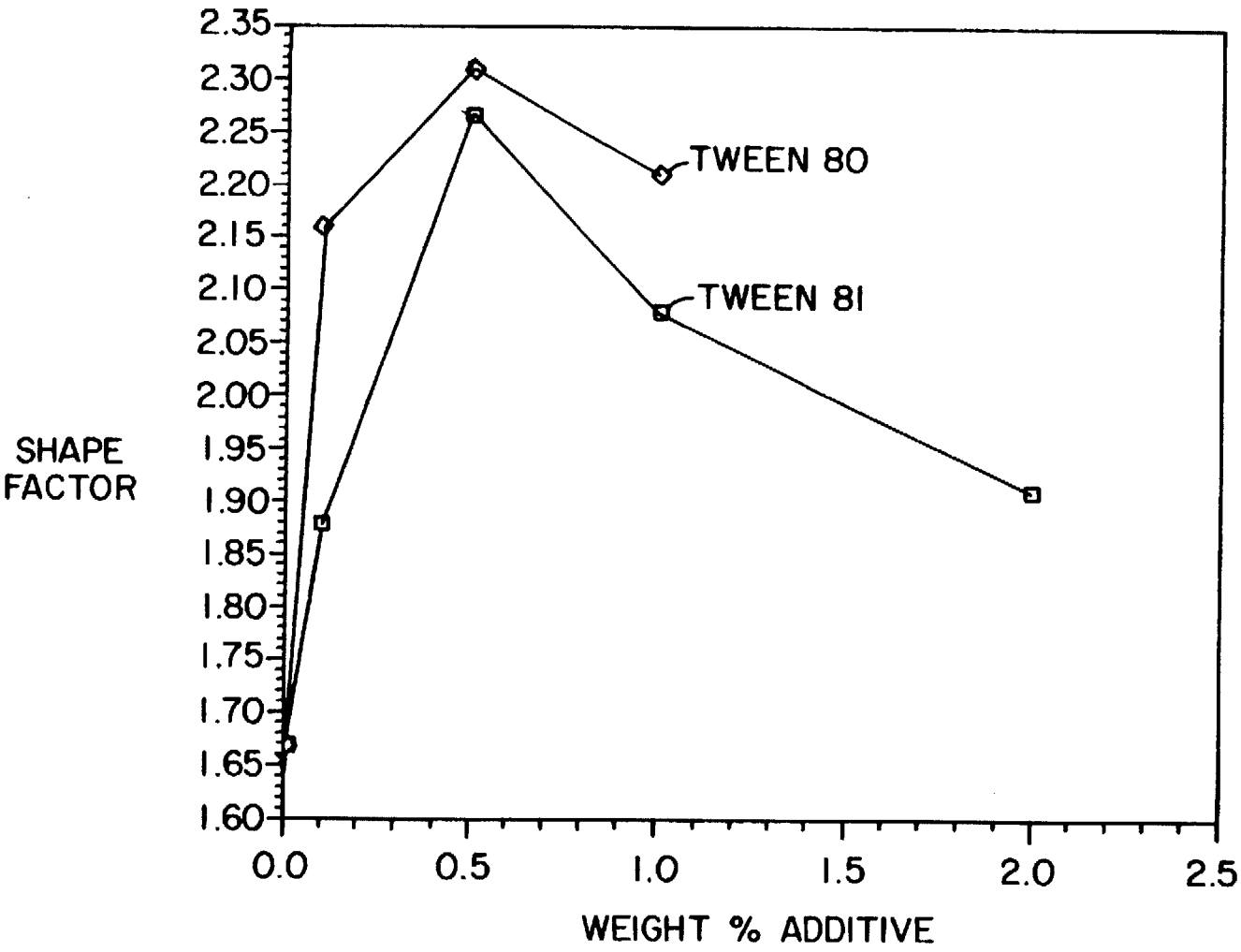
FIG. 10 is graph showing the effect of the amount of TWEEN® additives on the shape factor of Nylon 66 fibers of Examples 21–22.

Tween 80 and Tween 81 are ethoxylated fatty acids available from ICI Specialty Chemicals of Wilmington, Del. Tween 80 is a polyoxethylene (20) sorbitan monooleate and Tween 81 is a polyoxethylene (5) sorbitan monoleate. Both were injected into the extruder at levels up to 2 wt % with ZYTEL Nylon 66 101 available from DuPont Co. of Wilmington, Del. The polymer was dried overnight in a desiccant dryer at 80° C. The extruder was operated at 275° C. Other spinning conditions were similar to Examples 1–8. The effectiveness of the additives in Nylon 66 is seen in FIG. 10 as the shape factor is increased.

When Tween 80 in Example 23 and Tween 81 in Example 24 were added to polyester using conditions as in Examples 1–8 they were not effective shape preservers. In Example 25 a primary aliphatic amide of a fatty acid was added to polyester. Kenamide S available from Humko Chemical Division, Witco Corp. of Memphis, Tenn. was found not to be an effective shape preserver for polyester fibers. Kenamide S is a saturated fatty primary amide of stearic acid.

A wide range of polydimethylsiloxanes having various molecular weights may be useful in practicing the present invention. Numerous silicone copolymers or blends of silicone copolymers may also be used in this invention. The copolymers or blends may have varying molecular weights, ethylene oxide to propylene oxide ratios and hydrophilic to lipophilic balances. They may be, for example, a linear polydimethylsiloxane type with a polymer such as polyether having been grafted through a hydrosilation reaction or a branched polydimethylsiloxane type with a polymer such as polyether having been attached through condensation chemistry.

The additives and polymer may be combined in a variety of ways. For example, the additive in concentrate may be mixed with the bulk polymer prior to placing into an extruder. Alternatively, the additive may be introduced by metering or injection into an extruder containing the polymer at various points such as at a feed throat, a transition or metering zone, a mixing section, or a spin block.

The new fibers having improved cross-sectional shape retention are useful in absorbent products such as wound care items, diapers, catamenial products, and adult incontinent products. Such uses of the fibers in absorbent products are described in U.S. application Ser. No. 737,267 filed Jul. 23, 1991, which is a continuation-in-part of U.S. application Ser. No. 333,651 filed Apr. 4, 1989, now abandoned, the disclosure of which is incorporated herein by reference. They are also useful as fiber-fill and in other insulation products such as apparel, footwear, gloves and sporting apparel. Such insulation products are described in U.S. application Ser. No. 654,433 filed May 28, 1996, which is a divisional of U.S. application Ser. No. 510,950 filed Jul. 31, 1995, now abandoned, which is a continuation of U.S. application Ser. No. 311,998 filed Sep. 26, 1994, now abandoned, the disclosure of which is incorporated herein by reference.

The invention has been described in detail with particular reference to preferred embodiments thereof, but it will be understood that variations and modifications can be effected within the spirit and scope of the invention.

We claim:

1. A method of improving shape retention of a noncircular cross-sectional fiber comprising the steps of:

a) combining about 99.9 to about 98.5 weight percent of at least one polyester and about 0.1 to about 1.5 weight percent additive to form a melt extrusion composition, b) extruding said melt extrusion composition through a non-circular cross-sectional shaped spinneret hole to form a fiber having at least four percent improvement in shape retention as compared to a second fiber made from a second melt extrusion composition of said at least one polyester without said additive and extruded through said spinneret hole, said fiber being in its molten filament state, c) quenching said fiber, and d) taking up said fiber wherein said additive is surface active, capable of lowering the surface tension of said fiber in its molten filament state, and effective to impart to said fiber at least four percent improvement in shape retention.

2. The method of claim 1 wherein said polyester is combined in an amount of about 99.6 to about 99.0 weight percent with said additive in an amount of about 0.4 to about 1.0 weight percent.

3. A method of improving shape retention of a non-circular cross-sectional fiber comprising the steps of:

a) combining about 99.9 to about 98.5 weight percent of at least one polyester and about 0.1 to about 1.5 weight percent additive to form a melt extrusion composition, said additive is selected from the group consisting of a silicone, silicone copolymer or fluoroaliphatic polymeric ester, b) extruding said melt extrusion composition through a non-circular cross-sectional shaped spinneret hole to form a fiber having at least four percent improvement in shape retention as compared to a second fiber made from a second melt extrusion composition of said at least one polyester without said additive and extruded through said spinneret hole, c) quenching said fiber, and d) taking up said fiber.

4. The method of claim 3 wherein said additive is polydimethylsiloxane.

5. The method of claim 3 wherein said additive is a polyalkylene oxide modified polydimethylsiloxane.

6. The method of claim 3 wherein said additive is a polyether-polymethylsiloxane copolymer.

7. The method of claim 3 wherein said polyester is combined in an amount of about 99.6 to about 99.0 weight percent with said additive in an amount of about 0.4 to about 1.0 weight percent.

8. The method of claim 3 wherein said fiber has at least forty percent improvement in shape retention.

9. The method of claim 1 wherein said fiber has at least forty percent improvement in shape retention.

* * * * *

UNITED STATES PATENT AND TRADEMARK OFFICE

CERTIFICATE OF CORRECTION

PATENT NO. : 5,753,166

DATED : May 19, 1998

INVENTOR(S) : DALTON et al.

It is certified that error appears in the above-identified patent and that said Letters Patent are hereby corrected as shown below:

Please delete current line [62] on the `title page and replace with`
--[62] Division of Ser. No. 639,229, Apr. 30, 1996, abandoned.--

Signed and Sealed this

Tenth Day of April, 2001

*Attest:*

Nicholas P. Godici

NICHOLAS P. GODICI

*Attesting Officer*

*Acting Director of the United States Patent and Trademark Office*